US008851612B2

(12) United States Patent
Yatsunami

(10) Patent No.: US 8,851,612 B2
(45) Date of Patent: Oct. 7, 2014

(54) LIQUID EJECTING APPARATUS AND METHOD FOR DETECTING MEDIUM EDGE POSITION IN LIQUID EJECTING APPARATUS

(71) Applicant: Seiko Epson Corporation, Tokyo (JP)

(72) Inventor: Tetsuji Yatsunami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/778,960

(22) Filed: Feb. 27, 2013

(65) Prior Publication Data

US 2013/0222458 A1 Aug. 29, 2013

(30) Foreign Application Priority Data

Feb. 28, 2012 (JP) ..... 2012-041837

(51) Int. Cl.
*B41J 29/38* (2006.01)
*B41J 11/00* (2006.01)

(52) U.S. Cl.
CPC ..... *B41J 11/0095* (2013.01)
USPC ..... 347/16

(58) Field of Classification Search
CPC .... B41J 29/393; B41J 11/0095; B41J 11/003; B41J 11/009; B41J 19/205
USPC ..... 347/16, 19, 37, 101, 104
See application file for complete search history.

(56) References Cited

U.S. PATENT DOCUMENTS 6,945,721 B2 * 9/2005 Sato ..... 400/708
7,533,959 B2 * 5/2009 Ouchi et al. ..... 347/37
8,317,292 B2 * 11/2012 Murray et al. ..... 347/19

FOREIGN PATENT DOCUMENTS

JP 2002-127521 A 5/2002
JP 2003-260829 A 9/2003
JP 2004-314410 A 11/2004
JP 2005-329556 A 12/2005
JP 2007-098760 A 4/2007
JP 2007-276135 A 10/2007
JP 2010-194748 A 9/2010

* cited by examiner

*Primary Examiner* — An Do
(74) *Attorney, Agent, or Firm* — Global IP Counselors, LLP

(57) ABSTRACT

To provide a liquid ejecting apparatus and a method for detecting a medium edge position in a liquid ejecting apparatus, whereby the position of an edge of a medium can be detected while also avoiding an event where a protrusion present in a region targeted for detection by an optical sensor is erroneously detected as being the medium, a carriage is moved so as to traverse a sheet of paper in the width direction, and a determination is made as to whether or not an output voltage of a sheet width sensor provided to the carriage has crossed over a first threshold value.

8 Claims, 9 Drawing Sheets

EDGE DETECTION PROCESSING UNIT

| | FIRST EDGE | SECOND EDGE |
|---|---|---|
| CORRECTION AMOUNT dx (mm) | dx1 (−2.6) | dx2 (2.5) |

CD

LIQUID EJECTING APPARATUS AND METHOD FOR DETECTING MEDIUM EDGE POSITION IN LIQUID EJECTING APPARATUS

CROSS-REFERENCE TO RELATED APPLICATIONS

This application claims priority to Japanese Patent Application No. 2012-041837 filed on Feb. 28, 2012. The entire disclosure of Japanese Patent Application No. 2012-041837 is hereby incorporated herein by reference.

BACKGROUND

1. Technical Field

The present invention relates to a liquid ejecting apparatus provided with a liquid ejecting head for ejecting a liquid onto a medium such as a sheet of paper, and a light reflection optical sensor for detecting an edge position of the medium, and also relates to a method for detecting a medium edge position in a liquid ejecting apparatus.

2. Background Technology

An ink jet printer has been known as one example of this kind of liquid ejecting apparatus. Provided to the printer is a carriage which moves in a movement direction (main scanning direction) intersecting with a conveyance direction for sheets of paper, and which has a liquid ejecting head (a recording head). During printing, ink droplets are ejected from the liquid ejecting head toward a sheet of paper while the carriage is being moved, whereby an image or the like is printed onto the sheet of paper (for example, Patent Documents 1-4, etc.).

In, for example, the printers described in Patent Documents 1 to 4, a light reflection optical sensor (an edge sensor) was provided to the carriage, and a widthwise edge position of the sheet of paper was detected by the optical sensor while the carriage was being moved in the movement direction. More specifically, a detection value from the optical sensor and a threshold value are compared against each other, and when the detection value changes to being the threshold value or lower or to being the threshold value or higher, the current sensor position is determined to be an edge detection position (edge position) of the sheet of paper.

It has been noted that an ink mist generated when the liquid ejecting head ejected the ink droplets was present in the vicinity of a movement path of the carriage, as was suspended matter such as paper dust generated from the sheet of paper due to sliding over a conveyor roller, or the like. When the suspended matter sticks and the optical sensor is fouled, there is a gradual reduction in the amount of light received thereby, whereupon this has resulted in changes to a correction amount used in order to correct for an amount of positional deviation between the edge detection position at which the edge position of the sheet of paper was detected and the actual edge position of the sheet of paper, i.e., to correct by an amount commensurate with this amount of positional deviation. In order to resolve this, in a printer apparatus described in Patent Document 1, a threshold value that is optimal for every iteration is re-determined for every iteration of printing, and thus it is possible to detect the edge position with high positional accuracy by using a threshold value that is optimal and has not been impacted even by aging changes in the surface state of a support base nor by aging changes caused by fouling of the optical sensor.

In printers described in Patent Documents 2 and 3, a rib (protrusion) of a support base and a portion other than the rib (a groove part) are detected by an optical sensor (a recording sheet detection sensor), a detection sensitivity of the optical sensor is determined on the basis of a comparison (ratio or difference) between respective detection voltages (output values), and a threshold value corresponding to the detection sensitivity is set. For this reason, there will be a constant amount of positional deviation between the edge detection position of when the detection value of the optical sensor crosses over the threshold value and the actual edge position, and thus the edge position can be detected at high positional accuracy when corrected with a constant correction amount corresponding to the amount of positional deviation thereof.

Japanese Laid-open Patent Publication No. 2002-127521 (for example, paragraphs [0037]-[0052], FIG. 4, FIG. 5, etc.) (Patent Document 1), Japanese Laid-open Patent Publication No. 2003-260829 (for example, paragraphs [0053]-[0059], FIG. 5, FIG. 6, etc.) (Patent Document 2), Japanese Laid-open Patent Publication No. 2010-194748 (for example, paragraphs [0046]-[0050], FIG. 5, etc.) (Patent Document 3), and Japanese Laid-open Patent Publication No. 2005-329556 (for example, paragraphs [0032], [0037]-[0040], FIG. 9, FIG. 6, etc.) (Patent Document 4) are examples of the related art.

SUMMARY

Problems to be Solved by the Invention

It has been noted that in Patent Documents 2 and 3, because the rib of the support base is a portion that supports the sheet of paper, a progressive increase in the cumulative number of printed sheets is accompanied by a paper support surface of the rib being increasingly abraded so as to be mirror-like due to the sliding of the sheet of paper, and by the reflectivity of the surface thereof being increasingly higher. For this reason, in some cases the difference between the amount of light received by the optical sensor receiving the reflected light reflected by the surface of the sheet of paper and the amount of light received by the optical sensor receiving the reflected light reflected by the surface of the rib has become extremely small. In such cases, there has been a concern that when the output value of the optical sensor receiving the reflected light reflected by the surface of the rib reaches a value that is greater than the threshold value, the result is that when the carriage is in the processing of moving in order to detect the edge of the sheet of paper, the optical sensor will instead detect the edge of the rib, erroneously detecting same as the edge of the sheet of paper.

The invention has been contrived in view of the foregoing problems, and one advantage thereof is to provide a liquid ejecting apparatus and a method for detecting a medium edge position in a liquid ejecting apparatus, whereby the position of the edge of the medium can be detected while also avoiding an event where a protrusion present in a region targeted for detection by the optical sensor is erroneously detected as being the medium.

Means Used to Solve the Above-Mentioned Problems

In order to achieve the foregoing one advantage, the essence of one aspect of the invention resides in being provided with: a liquid ejecting head for ejecting a liquid toward a medium; a light reflection optical sensor which is provided to a carriage able to move in a movement direction that intersects with a conveyance direction for the medium, which has a light-emitting unit and a light-receiving unit, and which outputs an output value corresponding to an amount of light received by the light-receiving unit; a support unit having a plurality of protrusions for supporting the medium; a first detection unit for detecting an edge of the medium by comparing a threshold value at which the medium can be detected and the protrusions cannot be detected and an output value of the optical sensor moving the movement direction in a state where the medium has been conveyed to a position at which detection by the optical sensor is possible; and a second detection unit for detecting a position of the edge by using the output value of the optical sensor and a comparison value when the edge of the medium is detected by the first detection unit.

According to the foregoing configuration, the first detection unit detects the edge of the medium by comparing the threshold value and the output value of the optical sensor while the carriage is in the process of moving in the movement direction, in a state where the medium has been conveyed to a position at which detection by the optical sensor is possible. The threshold value that is used herein is set to a value at which the medium can be detected and the protrusions of the support unit cannot be detected, and thus the edge of the medium can be detected without the protrusions being erroneously detected as being same. Also, when the edge of the medium is detected, the second detection unit next detects the position of the edge by using the comparison value and the output value of the optical sensor. In a case where, for example, the medium were to be detected with only the second detection unit, there would be a concern that the edge of the protrusions might be erroneously detected as being the edge of the medium, but because the invention follows a procedure in which the first detection unit uses the threshold value, at which the protrusions cannot be detected, to detect the edge of the medium, and, following the detection of the edge of the medium, the second detection unit detects the position of the edge thus detected, it is therefore possible to detect the edge position of the medium while also avoiding erroneous detection of the edge of the protrusions as being the edge of the medium.

In a liquid ejecting apparatus which is one aspect of the invention, preferably, in a case where the threshold value is a first threshold value, the comparison value is a second threshold value, and the second detection unit detects a position of when the output value of the optical sensor crosses over the second threshold value as being the position of the edge of the medium.

According to the foregoing configuration, the edge of the medium is detected in response to when the output value of the optical sensor crosses over the first threshold value, and thereafter the position of the edge of the medium is detected in response to when the output value crosses over the second threshold value. This manner of carrying out a two-step detection process by using two different types of threshold values makes it possible to reliably detect the edge position while also avoiding a situation where the edge of the protrusions is detected erroneously as being the edge of the medium.

In a liquid ejecting apparatus which is one aspect of the invention, preferably, a dark region where an amount of light received by the light-receiving unit receiving the reflected light formed when the light from the light-emitting unit is reflected becomes less than that of the protrusions is provided to a region targeted for detection by the optical sensor, the liquid ejecting apparatus being further provided with: a measurement unit for measuring the amount of light received by the light-receiving unit receiving the reflected light of the light with which the dark region is irradiated by the light-emitting unit; and a threshold value setting unit for setting the second threshold value to a value found by multiplying a measurement value of the amount of received light by a constant.

According to the foregoing configuration, the measurement unit measures the amount of light received by the light-receiving unit receiving the reflected light reflected by the dark region. Also, the threshold value setting unit sets the second threshold value to a value found by multiplying the measurement value of the amount of received light by the constant. When, for example, the optical sensor is fouled or the like, the amount of light received is reduced, and there is a decline in the sensitivity thereof, then the amount of light received by the optical sensor when at the position for detecting the edge position of the medium also declines at the same ratio as the amount of received light for when the dark region is being detected. For this reason, when the second threshold value is set to the value found by multiplying by the constant the measurement value of the amount of light received when the dark region is detected, then the position of when the output value of the optical sensor crossed over the second threshold value (the edge detection position) will be the same, regardless of differences in the sensitivity (fouling). Accordingly, a correction amount for when the position of the edge is found by correcting the edge detection position can be given a constant value, because the amount of positional deviation between the edge detection position of the medium and the actual position of the edge of the medium will be substantially constant. Because the correction amount can in this manner be a constant value regardless of the differences in the sensitivity (fouling) of the optical sensor, the edge position detection processing can be made to be relatively simpler.

In a liquid ejecting apparatus which is one aspect of the invention, preferably, the constant is set to a value allowing for the second threshold value to be set to a range between the output value of the optical sensor for when the dark region is what is targeted for detection and the output value of the optical sensor for when the medium is what is targeted for detection.

According to the foregoing configuration, the second threshold value found by multiplying the measurement value by a constant is set to a range between the output value of the optical sensor for when the dark region is what is targeted for detection and the output value of the optical sensor for when the medium is what is targeted for detection. Accordingly, the output value of the optical sensor is able to cross over the second threshold value, and it becomes possible to detect the edge position of the medium. In a case where, for example, the second threshold value is set outside of the above-given range, the output value will not cross over the second threshold value, and it becomes impossible to actually detect the edge position of the medium. However, setting the second threshold value to the above-given range makes it possible for the output value of the optical sensor to cross over the second threshold value, thus making it possible to detect the edge position of the medium.

In a liquid ejecting apparatus which is one aspect of the invention, preferably, a dark region where an amount of light received by the light-receiving unit receiving the reflected light formed when the light from the light-emitting unit is reflected becomes less than that of the protrusions is provided to a region targeted for detection by the optical sensor, the liquid ejecting apparatus being further provided with a measurement unit for measuring the amount of light received by the light-receiving unit receiving the reflected light of the light with which the dark region is irradiated by the light-emitting unit, and the second detection unit multiplies the output value of the optical sensor by a constant prescribed on the basis of a ratio between a measurement value of the amount of received light and an initial value of the measurement value, and detects as the position of the edge of the medium a position of when the output value multiplied by the constant crosses over the second threshold value.

According to the foregoing configuration, the measurement unit measures the amount of light received by the light-receiving unit receiving the reflected light reflected by the dark region. The second detection unit multiplies the output value of the optical sensor by the constant prescribed on the basis of the ratio between the measurement value of the amount of received light and an initial value thereof, and detects as the position of the edge of the medium a position of when the output value multiplied by the constant crosses over the second threshold value. When, for example, the optical sensor is fouled or the like, the amount of light received is reduced, and there is a decline in the sensitivity thereof, then the amount of light received by the optical sensor when at the position for detecting the edge position of the medium also declines at the same ratio as the amount of received light for when the dark region is being detected. When the output value used is the value found by multiplying the output value by the constant prescribed on the basis of the measurement value of the amount of received light for when the dark region is detected and the initial value thereof, then the second detection unit is able to use a constant second threshold value even though the optical sensor is fouled and the sensitivity thereof has changed. For this reason, because there is no need to alter the second threshold value even when the sensitivity of the optical sensor has changed, the edge position detection processing can be made to be relatively simpler.

In a liquid ejecting apparatus which is one aspect of the invention, preferably, after the output value and the position of the optical sensor have been sequentially stored in a storage unit during the movement of the carriage and the edge of the medium has been detected by the first detection unit, the second detection unit detects the position of the edge by using the output value and the comparison value, by using a data group of the positions and the output values stored in the storage unit.

According to the foregoing configuration, even though the position where the output value crosses over the second threshold value (the edge position) will already have been passed when the first detection unit detects the edge of the medium, the storage unit stores the data group of the positions and the output values of the optical sensor up until that time. For this reason, even though the optical sensor has already passed the position of the edge at the point in time when the edge of the medium is detected, the second detection unit is able to detect the position of the edge by using the output value and the comparison value, by using the data group of the positions and the output values stored in the storage unit. Because of this, the movement direction of the optical sensor for when the position of the edge of the medium is to be detected is not constrained, but rather it would be possible, for example, to detect the position of both ends of the medium with one instance of movement of the carriage in one direction.

In a liquid ejecting apparatus which is one aspect of the invention, preferably, the liquid ejecting apparatus is further provided with a correction unit for acquiring the position of the edge of the medium by correcting with a constant correction amount the edge detection position detected by the second detection unit.

According to the foregoing configuration, there is no need to, for example, consult or compute a table for acquiring the correction amount, because the correction amount by which the correction unit corrects the edge detection position is constant. Accordingly, the position of the edge can be found on the basis of the edge detection position with a relatively simple process.

The essence of one aspect of the invention resides in being a method for detecting a medium edge position in a liquid ejecting apparatus, the method including: a first detection step for detecting an edge of a medium by comparing an output value of an optical sensor moving in a movement direction that intersects with a conveyance direction of the medium, in a state where the medium has been conveyed to a position where detection by the optical sensor is possible, and a threshold value at which the medium can be detected and a plurality of protrusions for supporting the medium cannot be detected; and a second detection step for detecting the position of the edge by using a comparison value and the output value of the optical sensor, when the edge of the medium is detected in the first detection step. According to the foregoing method, an effect similar to that of the invention relating to the liquid ejecting apparatus can be obtained.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

What follows is a description of a first embodiment, in which the liquid ejecting apparatus of the invention is embodied as an ink jet printer, with reference to FIGS. 1 to 12.

Figure 1:
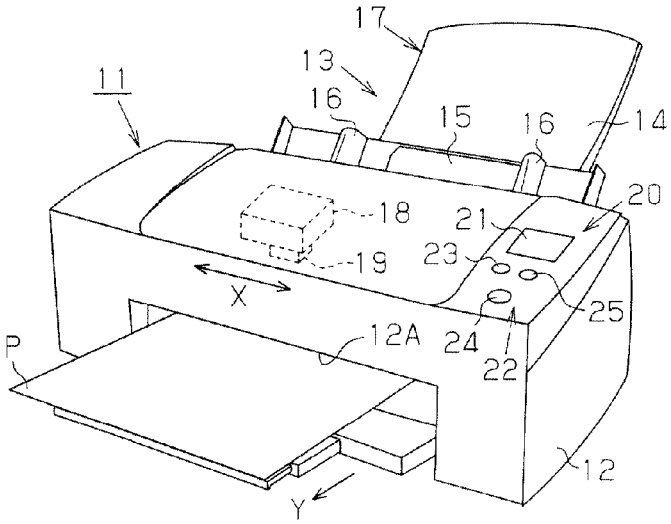
FIG. 1 is a perspective view of a printer in a first embodiment.

As illustrated in FIG. 1, the ink jet printer which is one example of the liquid ejecting apparatus (hereinafter, simply called a "printer 11") is equipped with an auto sheet feeder device 13 for conveying a sheet of paper P (sheet), serving as one example of medium, at the rear side of a main body 12.

The auto sheet feeder device 13 is provided with a sheet feeder tray 14, a hopper 15, and a paper sheet guide 17 having edge guides 16, and feeds sheets of paper having been set into the paper sheet guide 17 one sheet at a time to the inside of the main body 12. The left/right pair of edge guides 16 guide a sheet of paper P in the width direction, centered on a widthwise middle position of the sheet feeder tray 14.

Inside of the main body 12, a carriage 18 is provided in a state allowing reciprocating movement in a movement direction X (a main scanning direction) along a movement path thereof, and a liquid ejecting head 19 is attached at a lower part of the carriage 18. Substantially in alternation, the printer 11 repeats a recording operation, in which ink droplets are ejected onto the surface of the sheet of paper P from the liquid ejecting head 19 while the carriage 18 is in the process of moving in the movement direction X, and a sheet feed operation, in which the sheet of paper P is conveyed by a requested conveyance amount in a conveyance direction Y (a secondary scanning direction) intersecting with the movement direction X; an image, text, or the like based on given print data is printed onto the sheet of paper P. The sheet of paper P after printing is discharged from a sheet discharge port 12A opening on a front side lower part of the main body 12.

An operation panel 20 is also provided to an upper surface end part of the main body 12. Provided to the operation panel 20 are a display unit 21, including a liquid crystal display panel or the like, and an operation switch 22. Provided to the operation switch 22 are a power source switch 23, a print start switch 24, a cancel switch 25, and the like. The display unit 21 can be a touch panel.

Figure 2:
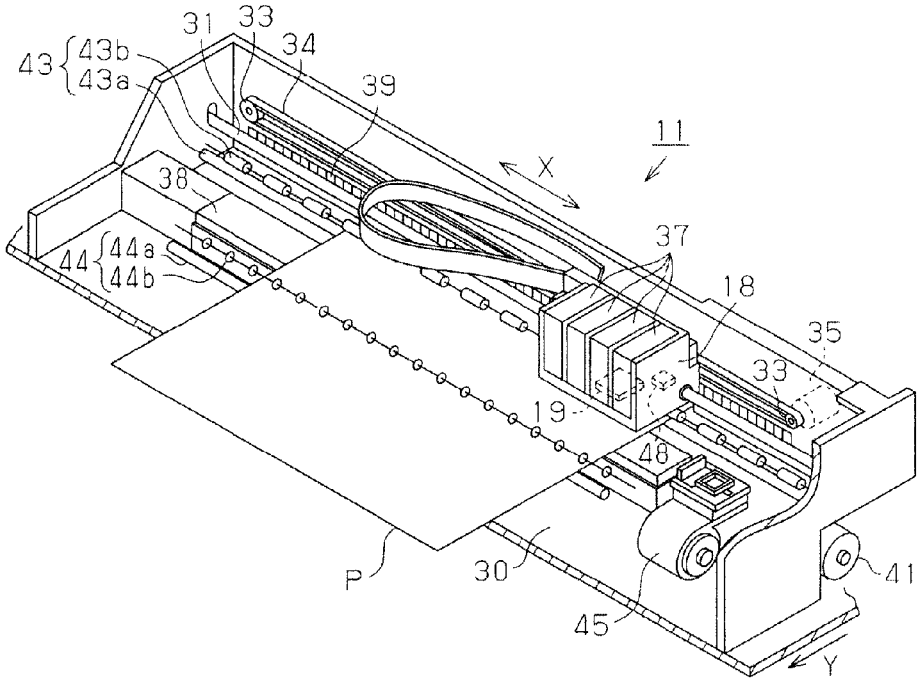
FIG. 2 is a perspective view illustrating a configuration of a printer.

Next, the internal configuration of the printer 11 shall be described. As is illustrated in FIG. 2, the printer 11 has a substantially quadrangular box-shaped main body frame 30, the upper side and front side of which are open; the carriage 18 is attached in a state allowing reciprocating movement in the movement direction X at a guide shaft 31, which is bridged between left and right side walls of the main body frame 30 in FIG. 2. An endless timing belt 34 is wound about a pair of pulleys 33 mounted onto an inner surface of a back plate of the main body frame 30, and the carriage 18 is fixed to a part of the timing belt 34. Coupled to the right-side pulley 33 in FIG. 2 is a drive shaft (output shaft) of a carriage motor 35; when the carriage motor 35 is driven forward and in reverse and the timing belt 34 drives forward and in reverse, the carriage 18 is thereby moved reciprocatingly in the movement direction X.

A plurality (for example, four) of ink cartridges 37 in which different colors of ink (for example, the four colors of black (K), cyan (C), magenta (M), and yellow (Y)) are respectively contained are loaded into an upper part of the carriage 18. Ink that is supplied from each of the ink cartridges 37 is respectively ejected from nozzles in a corresponding nozzle row NA (see FIG. 5), there being the same number of nozzle rows formed on the liquid ejecting head 19 (in the present example, four) as there are colors of ink. A support base 38, serving as one example of a support unit, for regulating the interval (gap) between the liquid ejecting head 19 and the sheet of paper P is provided to a position below the movement path of the carriage 18 so as to extend in the movement direction X. The ink colors that can be ejected by the liquid ejecting head 19 need not be four in number; there can also be one color, three colors, or five to eight colors.

A linear encoder 39 for outputting a number of pulses that is proportional to an amount of travel by the carriage 18 is provided to a back surface side of the carriage 18 so as to extend along the guide shaft 31. In the printer 11, positional control and speed control of the carriage 18 are carried out on the basis of a pulse signal that is outputted from the linear encoder 39.

A conveyance motor 41 is disposed at a right-side lower part in FIG. 2 of the main body frame 30. A sheet feeder roller (not shown) is driven by the power of the conveyance motor 41, whereby the sheets of paper P that have been set into the sheet feeder tray 14 (see FIG. 1) are fed out one sheet at a time. A conveyor roller pair 43 and a discharge roller pair 44 are arranged on a downstream side and upstream side thereof, respectively, sandwiching the support base 38 in the conveyance direction Y. Each of the roller pairs 43, 44 includes a drive roller 43*a*, 44*a* that is rotated by the power of the conveyance motor 41 and a driven roller 43*b*, 44*b* that turns together with the rotation of the drive roller 43*a*. When the conveyance motor 41 is driven, the sheet of paper P is thereby conveyed in the conveyance direction Y (the secondary scanning direction) in a state of being sandwiched (nipped) between the two roller pairs 43, 44.

In FIG. 2, a position at one end on the movement path of the carriage 18 (in FIG. 2, this is the rightmost position) serves as a home position at which the carriage 18 remains on standby when printing is not taking place. A maintenance device 45 for cleaning and otherwise maintaining the liquid ejecting head 19 is disposed directly below the carriage 18 arranged at the home position. In the present embodiment, the conveyance motor 41 also serves as a source of power for the maintenance device 45. In addition, a sheet width sensor 48, serving as one example of an optical sensor, for detecting the ends (edges) on both sides of the sheet of paper P in the width direction (the movement direction X) is provided to the carriage.

Figure 5:
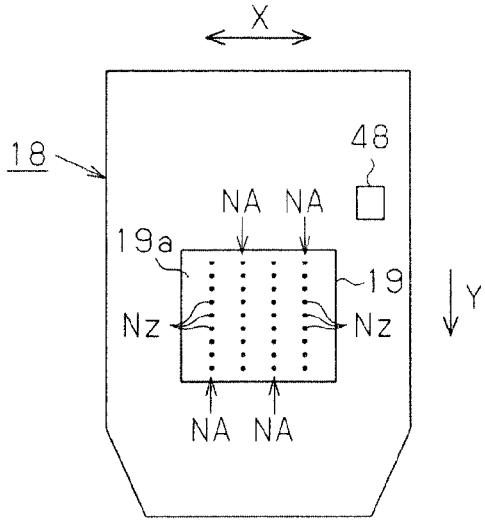
FIG. 5 is a bottom view of a liquid ejecting head.

FIG. 5 illustrates the bottom of the carriage. A plurality of nozzle rows NA, formed by a plurality of nozzles Nz being arrayed at a constant pitch in a direction serving as a conveyance direction Y in a state where the carriage 18 has been assembled in the printer 11, are arrayed at a predetermined spacing in the movement direction X on a nozzle formation surface 19*a* of the liquid ejecting head 19, which is attached to a substantially middle position of the bottom of the carriage 18. The ink that is supplied from the corresponding ink cartridge 37 is ejected from the nozzles Nz constituting the nozzle rows NA. The sheet width sensor 48 is attached on the bottom of the carriage 18 to a position farther on the upstream side in the conveyance direction Y than the liquid ejecting head 19.

Figures 3A, 3B:
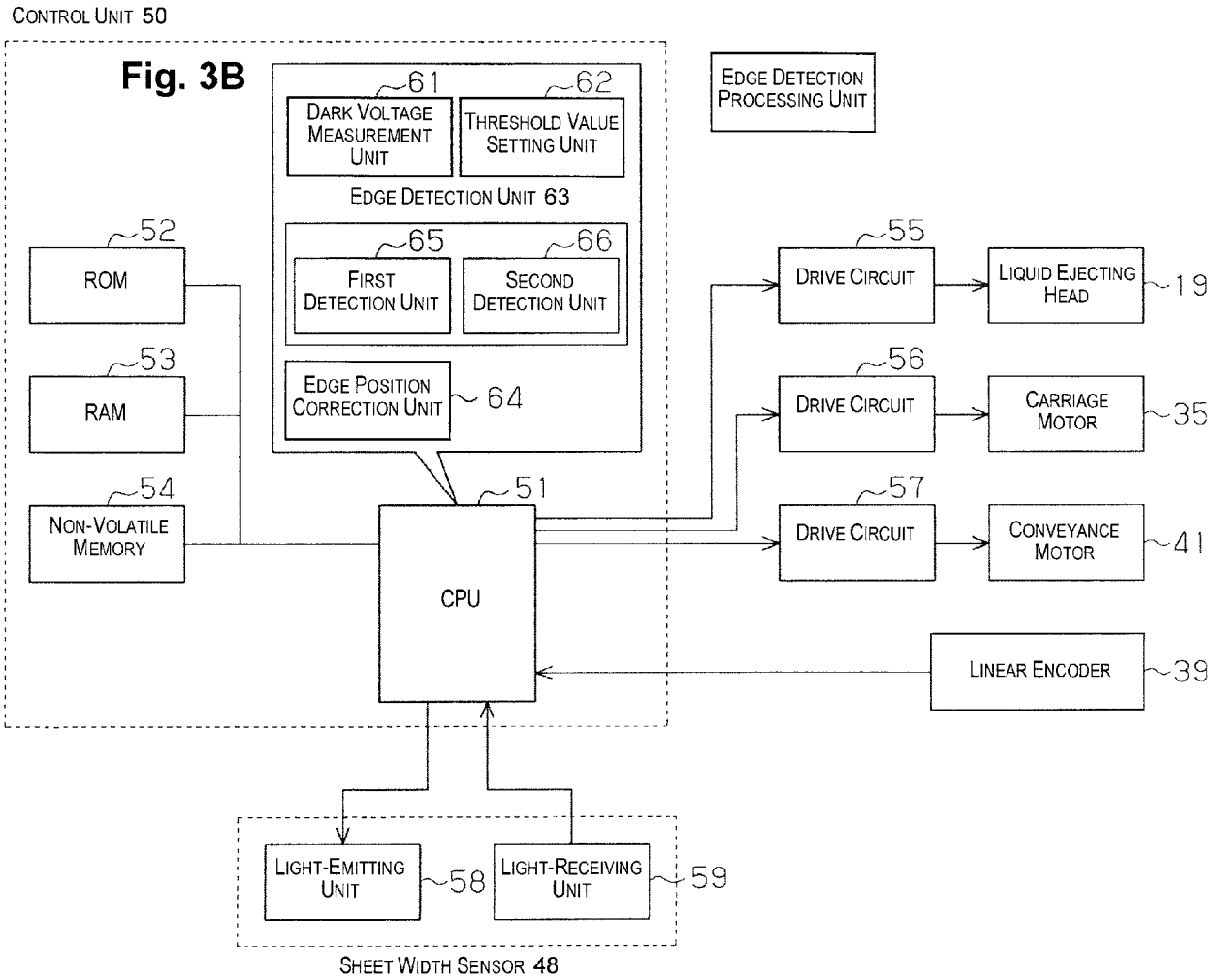
FIG. 3A is a block diagram illustrating an electrical configuration of a printer.
FIG. 3B is a block diagram illustrating a functional configuration of a control unit.

The electrical configuration of the printer 11 shall now be described on the basis of FIGS. 3A and 3B. The printer 11 illustrated in FIGS. 3A and 3B is provided with a control unit 50 for governing the overall control thereof. The control unit 50 is constituted of, for example, a computer (a microcomputer), and is provided with a CPU 51 (a central processing unit), a ROM 52, a RAM 53, and a non-volatile memory 54. The ROM 52 stores a variety of types of programs. Some programs, setting data for when a variety of types of programs are to be executed, and the like are stored in the non-volatile memory 54, which also retains the stored contents even when the power is turned off. The CPU 51 controls the print operation of the printer 11 and the like by executing programs stored in the ROM 52 and in the non-volatile memory 54. An application specific integrated circuit (ASIC) can also be added, with the data processing needed for drive control of the liquid ejecting head 19 and the like then being performed by the ASIC.

The control unit 50 drives and controls the liquid ejecting head 19 via a drive circuit 55 on the basis of print data, and causes ink to be ejected from the liquid ejecting head 19. The control unit 50 also drives and controls the carriage motor 35 via a drive circuit 56, and causes the carriage 18 to move reciprocatingly in the movement direction X. The control unit 50 further drives and controls the conveyance motor 41 via a drive circuit 57, and causes the sheet of paper P to be conveyed in the conveyance direction Y. The control unit 50 detects a position of the carriage 18 (carriage position) in the movement direction X, with the home position as the point of origin, on the basis of a pulse signal inputted from the linear encoder 39. More specifically, the control unit 50 is provided with a counter for using the point in time where the carriage 18 is at the home position as the point of origin to count the number of pulse edges of the pulse signal inputted from the linear encoder 39, and increments the count of the counter upon forward movement of the carriage 18 and decrements the count upon return movement of the carriage 18. For this reason, the count of the counter is meant to be indicative of the position of the carriage 18 in the movement direction X (the carriage position).

The sheet width sensor 48, which is connected to the control unit 50, is provided with a light-emitting unit 58 for irradiating light towards the support base 38 (in the present example, this is downward in the vertical direction) and a light-receiving unit 59 for receiving reflected light of the light irradiated from the light-emitting unit 58. The control unit 50 controls the light emission from the light-emitting unit 58, and receives the input of an output voltage corresponding to the amount of light received thereby from the light-receiving unit 59.

FIG. 3B illustrates a functional configuration which functions by the CPU 51 executing a program that is read from the ROM 52 or the non-volatile memory 54. As a function unit for functioning by the CPU 51 executing a program, the control unit 50 is provided with: a dark voltage measurement unit 61, serving as one example of a measurement unit; a threshold value setting unit 62; an edge detection unit 63; and an edge position correction unit 64 serving as one example of a correction unit.

The dark voltage measurement unit 61 is intended to detect the support base, which is a dark region of a comparatively lower light reflectivity, excepting the sheet of paper P, which is a bright region of a comparatively higher light reflectivity, and measures the amount of light received by the light-receiving unit 59 receiving the reflected light reflected by the support base 38. The dark voltage measurement unit 61 acquires a dark voltage Vd as a measurement value for the amount of light received thereby. On the basis of the dark voltage Vd, the threshold setting unit 62 sets a second threshold value, from among a first threshold value and a second threshold value used by the edge detection unit 63 in the process of detecting the edge position of the sheet of paper P. The edge detection unit 63 has a function for detecting the position of the edge of the sheet of paper P in the width direction, and is provided with a first detection unit 65 for detecting the edge of the sheet of paper P, and a second detection unit 66 for detecting the subsequently detected position of the edge (edge position) thereof Each of these units 61 to 66 shall be described in greater detail below.

Figure 4:
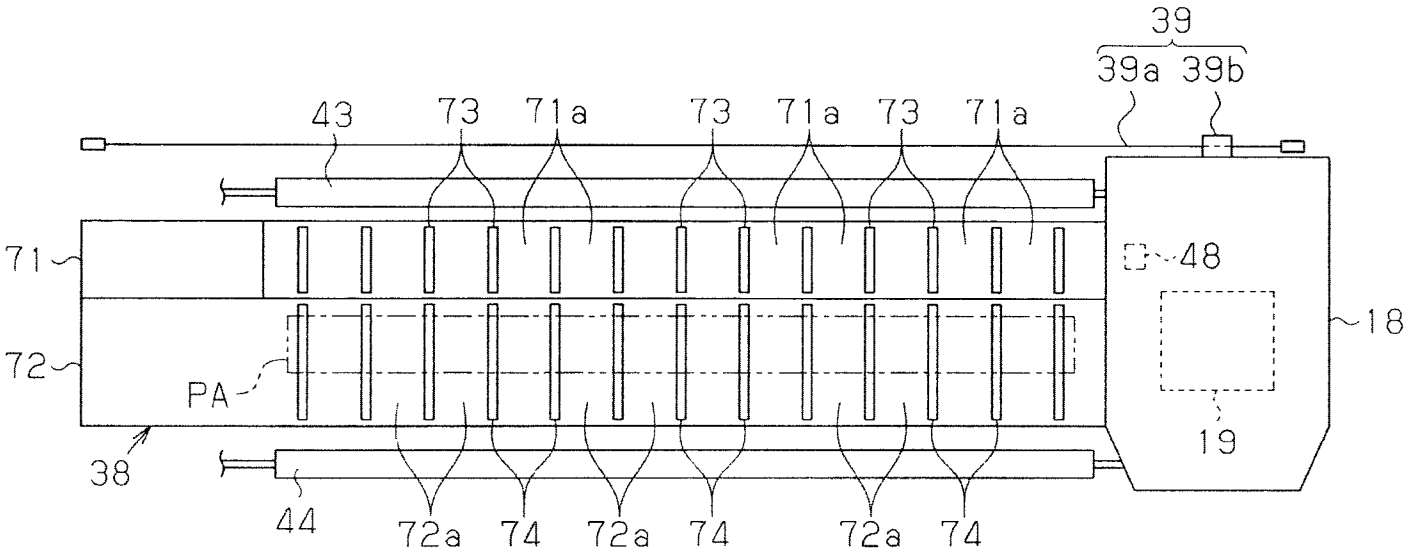
FIG. 4 is a schematic plan view illustrating a carriage, a support base, and so forth.

The support base 38 and the sheet width sensor 48 shall now be described in greater detail. FIG. 4 illustrates the support base and the carriage. Formed on the support base 38 are an upstream support surface located on the upstream side in the conveyance direction Y and a downstream support surface 72 located on the downstream side in the conveyance direction Y with respect to the upstream support surface 71. Upstream ribs 73, serving as one example of a protrusion, which project upward in the vertical direction (this is the front side of the plane of paper in FIG. 4) and extend in the conveyance direction Y are formed on the upstream support surface 71. Downstream ribs 74 that project out upward in the vertical direction and extend in the conveyance direction Y are formed on the downstream support surface 72. From the lower side in the vertical direction, both the upstream ribs 73 and the downstream ribs 74 support the sheet of paper P being conveyed, and the sheet of paper P illustrated in FIG. 2 is conveyed along the upstream ribs 73 and the downstream ribs 74.

As illustrated in FIG. 4, groove parts 71*a* (see FIG. 6) having a lower bottom than an upper end surface of the upstream ribs 73 are formed on portions other than the upstream ribs 73 in the upstream support surface 71. Also, groove parts 72*a* which have a lower bottom that an upper end surface of the downstream ribs 74 are formed on portions other than the downstream ribs 74 in the downstream support surface 72.

In FIG. 4, the right edge position at which the carriage 18 is located serves as the home position. A liquid ejecting region PA (print region), which is the maximum area where the liquid ejecting head 19 is able to eject ink drops for printing in the movement direction X of the carriage 18, is located atop the downstream support surface 72, as illustrated by the two-dot chain line in FIG. 4. The region targeted for detection by the sheet width sensor 48 is the upstream support surface 71, which is located further on the upstream side in the conveyance direction Y than the downstream support surface 72, at which the liquid ejecting region PA is located, and thus the region targeted for detection thereby is located on the outside of the liquid ejecting region PA. Ink drops ejected onto the vicinity of the outside of the sheet of paper P from the liquid ejecting head 19 during borderless printing attach to the downstream support surface 72, or ink drops ejected from the liquid ejecting head 19 during a paper jam attach thereto. By contrast, the upstream support surface 71 is comparatively less susceptible to the attachment of the ink mist or the like, in comparison to the downstream support surface 72 at which the liquid ejecting region PA is located.

The sheet of paper P, which is positioned in the width direction by the pair of edge guides 16 illustrated in FIG. 1, is fed out so that the width center thereof passes through a widthwise middle position of the conveyance path. For this reason, the position of the edge (edge position) of both sides of the sheet of paper in the width direction when the paper has been conveyed over the support base 38 in FIG. 4 is determined by the width of the sheet of paper P. In the present embodiment, the position of each of the upstream ribs 73 in the movement direction X is set for a sheet of paper P of a prescribed size so that the two edge positions thereof in the width direction are positioned to face the groove parts 71*a*. For this reason, both widthwise edges of the sheet of paper P having been conveyed over the support base 38 are positioned so as to face the groove parts 71*a* at all times (see FIG. 6).

Figure 7:
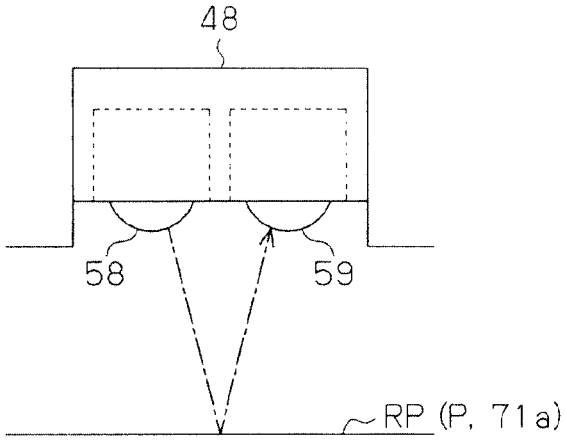
FIG. 7 is a schematic front view illustrating a sheet width sensor.

As illustrated in FIG. 7, the sheet width sensor 48, which is fixed to a surface facing the support base (38) on the carriage 18 (to a lower surface side), is attached to a position where the light-emitting unit 58 and the light-receiving unit 59 are comparatively closer, in a neighboring state. The distance between the optical axes of the light-emitting unit 58 and the light-receiving unit 59 is very short, and light that is irradiated vertically downward from the light-emitting unit 58 is reflected substantially vertically upward by a reflecting surface RP of an object intended to be irradiated with light, and reflected light thereof is received by the light-receiving unit 59. The optical paths of the irradiated light and the reflected light are schematically illustrated in FIG. 7 with single-dot chain lines extending at a slope. The reflecting surface RP of the object intended to be irradiated with light could be the surface of the sheet of paper P, the groove parts 71*a*, and so forth.

Figure 6:
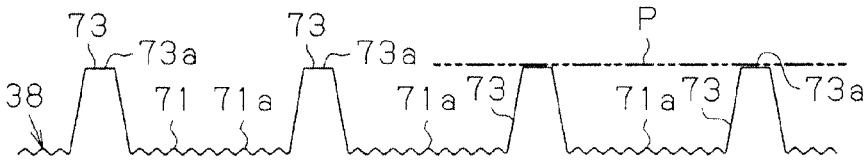
FIG. 6 is a schematic front view illustrating one part of a support base.

As illustrated in FIG. 6, the bottom of the groove parts 71*a* on the support base 38 is formed to be a relatively fine, wavy surface, and light that is irradiated substantially perpendicularly to the groove parts 71*a* from the light-emitting unit 58 is more prone to scattered reflection. For this reason, the groove parts 71*a* become a dark region, a much smaller amount of light is received by the light-receiving unit 59 from the light reflected by the groove parts 71*a*, and the output voltage of the light-receiving unit 59 (dark voltage Vd) is extremely small. The sheet of paper P, which has a high light reflectivity, serves as a bright region, where a correspondingly greater amount of light is received by the light-receiving unit 59 receiving the reflected light from the sheet of paper P, and the output voltage of the light-receiving unit 59 is correspondingly greater.

A support surface 73*a* of the upstream ribs 73 is abraded and gradually becomes like a mirror surface due to the sheet of paper P sliding over. For this reason, the reflectivity of the support surface 73*a* changes together with the passage of time, and is gradually elevated until finally become mirror-like. Accordingly, during edge position detection for the sheet of paper P, while the sheet width sensor 48 is moving, for example, in the rightward direction from the left end side in FIG. 6 and up until when [the sheet width sensor] moves to a position where the sheet of paper P is what is targeted for detection, then the groove parts 71*a* and the upstream ribs 73 are what is targeted for detection, in alternation, and the output voltage from when herein the upstream ribs 73 are what is targeted for detection is comparatively higher.

Figure 8A:
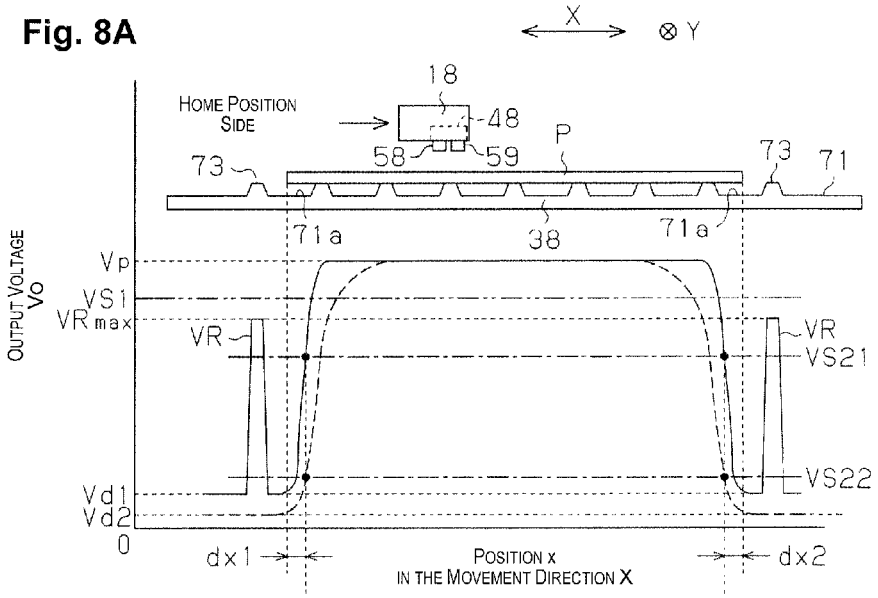
FIG. 8A is a graph illustrating the relationship between the position of a sheet width sensor in a movement direction and an output voltage.
Figure 8B:
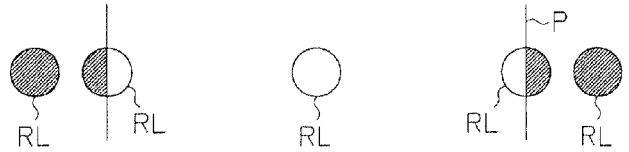
FIG. 8B is a schematic plan view illustrating the relationship between a sheet of paper and reflected light.

A method for detecting the edge position of the sheet of paper P by the sheet width sensor 48 shall now be described, with reference to FIGS. 8A and 8B. FIGS. 8A and 8B illustrate the example of a case where the carriage 18 moves in the movement direction X and the edge of the sheet of paper P are detected by the sheet width sensor 48, in a state where the sheet of paper P has been conveyed as far as a position where the support base 38 (more specifically, the upstream support surface 71) is covered. The graph illustrated in FIGS. 8A and 8B illustrates the relationship between a position x (hereinafter, also called a "sensor position x") of the sheet width sensor 48 in the movement direction X and the output voltage Vo of the light-receiving unit 59. In this graph, the graph line illustrated by the solid line illustrates the relationship between the sensor position x and the output voltage Vo at an initial stage before the sheet width sensor 48 has been fouled, and the graph line illustrated by the dashed line illustrates the relationship between the sensor position x and the output voltage Vo at a point in time where the sheet width sensor 48 has been fouled to such an extent that, for example, the sensitivity thereof reaches an allowable limit.

FIG. 8B illustrates the state of a column reflecting light RL reflected by either the groove parts 71*a* or the sheet of paper P while the edge position detection for the sheet of paper P is being carried out. The region where a lesser amount of light is reflected by the groove parts 71*a*, which is the dark region, is illustrated with a dark grey color, and a region where a greater amount of light is reflected by the surface of the sheet of paper P, which is the bright region, is illustrated with a white color. In FIG. 8B, the edge of the sheet of paper P illustrates the edge detection position, and is depicted at a position deviated somewhat farther inward than the actual edge position of the sheet of paper P illustrated in FIG. 8A.

In FIG. 8B, when the groove parts 71*a* on the outside of the sheet of paper P in the width direction are what is targeted for detection (when the reflected light RL is the dark grey color), an extremely low dark voltage Vd1 (or Vd2) is outputted from the light-receiving unit 59, which has received the reflected light RL of a lesser amount of light reflected by the groove parts 71*a*. When the paper reflected light, reflected by the surface of the sheet of paper P, accounts for one half of the reflected light RL, then the output voltage Vo will become greater than a second threshold value VS21 (or VS22), and a first edge of the sheet of paper P (the left side end in FIG. 8B) is detected. Furthermore, in a section where the sheet of paper P is what is targeted for detection, an output voltage VP (paper voltage) adequately smaller than the second threshold value VS21 (or VS22) is outputted from the light-receiving unit 59, which receives the reflected light RL where a greater amount of light is reflected by the surface of the sheet of paper P. Then, when the paper reflected light accounts for half of the reflected light RL, the output voltage Vo will become less than the second threshold value VS21 (or VS22), and a second edge of the sheet of paper P (the right edge in FIG. 8B) is detected.

As the sheet width sensor 48 becomes fouled from the initial state and the sensitivity thereof increasingly declines, the light amount of the reflected light RL also gradually decreases, and as regards the relationship between the position x and the output voltage Vo, the dark voltage Vd declines gradually from the graph line of the initial state illustrated with the solid line in FIG. 8A; also, the rising and falling lines for when the edge of the sheet of paper P is detected shift inward in the width direction of the sheet of paper. When the sheet width sensor 48 reaches a sensitivity limit due to fouling, the relationship between the position x and the output voltage Vo arrives at the graph line illustrated with the dashed line in FIG. 8A. In the present embodiment, the second threshold VS2 is set to a value that is K-fold the dark voltage Vd, whereby the output voltage Vo will cross over the second threshold VS2 at a position where the paper reflected light accounts for a constant value of the reflected light RL at all times (in the example in FIGS. 8A and 8B, this is 0.5 (50%)).

For this reason, the position x for when the output voltage Vo crosses over the second threshold VS2, i.e., the edge detection position of the sheet of paper P can be the same at all times, even though the sheet width sensor 48 is progressively fouled by the ink mist and the paper dust and though there is a decline in the sensitivity thereof. Because of this, the amount of positional deviation between the edge detection position and the actual edge position of the sheet of paper P will be constant at all times, and a correction amount dx used when the edge position is found from the edge detection position, i.e., a correction amount dx1 for the first edge side and a correction amount dx2 for a second edge side illustrated in FIG. 8A will be a constant value.

Meanwhile, the upstream ribs 73 are each present at positions further outward in the width direction than both widthwise edges of the sheet of paper P. In a case where the carriage 18 moves in the direction illustrated with the arrow in FIG. 8A, then before the first edge of the sheet of paper P is detected, the sheet width sensor 48 passes through an upper position of the upstream ribs 73 located further on the home position side than [the first edge], and after the second edge of the sheet of paper P has been detected, the sheet width sensor 48 passes through the upper position of the upstream ribs 73, further on an anti-home position side than [the second edge]. As will be understood from the graph illustrated in FIG. 8A, when the sheet width sensor 48 is at the position X where the upstream ribs 73 are what is targeted for detection, there appears a waveform of the output voltage for when the upstream ribs 73 are detected (hereinafter, also called a "rib waveform VR"). In a case where, for example, the support surface 73*a* of the upstream ribs 73 has been abraded so as to be mirror-like due to the sliding of the sheet of paper P and has reached a high reflectivity, then in some cases a maximum voltage VRmax of the rib waveform VR is appreciably closer to the paper voltage Vp, and, as illustrated in FIG. 8A, takes a greater value than the second threshold value VS2 (VS21, VS22 in FIG. 8A). In such a case, the rib waveform VR crosses over the second threshold value VS2, and the upstream ribs 73 are erroneously detected as being the sheet of paper P.

In the present embodiment, in order to avoid erroneous detection of the upstream ribs 73, a first threshold VS1 whereby the upstream ribs 73 cannot be detected and the sheet of paper P can be detected is set. The first threshold value VS1 is set to a value greater than an anticipated maximum voltage VRmax of the rib waveform VR, and smaller than the paper voltage Vp (which, in this example, is a saturation voltage) (VRmax<VS1<Vp). Then, in the first embodiment, the edge of the sheet of paper P is firstly detected while avoiding erroneous detection of the edge of the upstream ribs 73 by using the first threshold VS1, and when the edge of the sheet of paper P is detected, then the edge position of the sheet of paper P is detected by using the second threshold value VS2. In the present embodiment, the first threshold value VS1 is equivalent to one example of a threshold value, and the second threshold value is equivalent to one example of a comparison value.

Each of the units 61 to 66 in FIG. 3B shall now be described in greater detail. The dark voltage measurement unit 61 acquires the dark voltage Vd outputted by the light-receiving unit 59 receiving the reflected light of the light with which the groove parts 71*a* (the dark region) are irradiated by the light-emitting unit 58 of the sheet width sensor 48, the groove parts being in a state not covered by the sheet of paper P. The dark voltage Vd takes a value corresponding to the amount of light received by the light-receiving unit 59 when the sheet width sensor 48 is at a position where the groove parts 71*a* are what is targeted for detection. In this manner, the dark voltage measurement unit 61 measures the amount of light received by the light-receiving unit 59 when the sheet width sensor 48 is at a position where the groove parts 71*a* (the dark region) are what is targeted for detection, and acquires the dark voltage Vd as the measurement value therefrom.

The threshold value setting unit 62 sets the second threshold VS2 (=K·Vd) by multiplying the dark voltage Vd by a constant K. The constant K is a value greater than 1 (K>1), and is pre-set so that the second threshold value VS2 will be a value less than the paper voltage Vp.

The edge detection unit 63 detects the position of the edge of the sheet of paper P in the width direction on the basis of the output voltage Vo that is inputted from the light-receiving unit 59. The edge detection unit 63 is provided with the aforementioned first detection unit 65 and second detection unit 66, in order to detect the edge position of the sheet of paper P.

The first detection unit 65 compares the output voltage Vo of the sheet width sensor 48 and the first threshold value VS1 while the carriage 18 is in the process of moving in the movement direction X from one widthwise outward position of the sheet of paper P to another widthwise outward position in a state where the sheet of paper is being conveyed in the conveyance direction Y to a position where the upstream support surface 71 is covered, and detects the edge of the sheet of paper P in response to when the output voltage Vo crosses over the first threshold value VS1. The first threshold value VS1 is set to a value whereby the upstream ribs 73 will not be erroneously detected as being the sheet of paper P. The support surface 73*a* whereby the support ribs 73 support the sheet of paper P (see FIG. 6) is abraded by the sliding of the sheet of paper P, and ultimately becomes mirror-like; the reflectivity thereof thus comes rather close to the reflectivity of the sheet of paper P. The first threshold value VS1 is set to a value whereby even when the support surface 73*a* has, for example, become mirror-like (has a higher reflectivity), the output voltage Vo of the light-receiving unit 59 receiving the reflected light reflected by the support surface 73*a* does not cross over the threshold value. In other words, the first threshold value VS1 is set to a value enabling detection of the edge of the sheet of paper P but not permitting detection of the upstream ribs 73 by the sheet width sensor 48. That is, the first threshold value VS1 is set to a value that is greater than the maximum voltage VRmax of the rib waveform and is less than the paper voltage Vp (VRmax<VS<Vp). In this example, the threshold value VS is in particular VRmax+m1<VS<Vp−m2. Herein, m1 and m2 are margins.

When the first detection unit 65 detects the edge of the sheet of paper P, the second detection unit 66 next acquires as the edge detection position Xd of the sheet of paper P (an edge detection position) the position x of the sheet width sensor 48 for when the output voltage Vo crosses over the first threshold value VS1, from a comparison between the output voltage Vo of the sheet width sensor 48 and the first threshold value VS1. In the present example, in addition to the counter (not shown) for counting the position of the carriage 18 in the movement direction X (the carriage position) as ascertained on the basis of the pulse signal of the linear encoder 39, further provided is a counter (not shown) for counting the position x of the sheet width sensor 48 at that time, on the basis of the known distance in the movement direction X between the carriage position and the position of the sheet width sensor 48. When the output voltage Vo crosses over the first threshold value VS1, the second detection unit 66 acquires as the edge detection position Xd the count of the counter indicative of the sensor position x at that time. It shall be readily understood that the sensor position x can also be acquired by carrying out a computation for adding or subtracting a value commensurate with this distance to/from the count of the carriage counter (the carriage position).

Figures 9, 10:
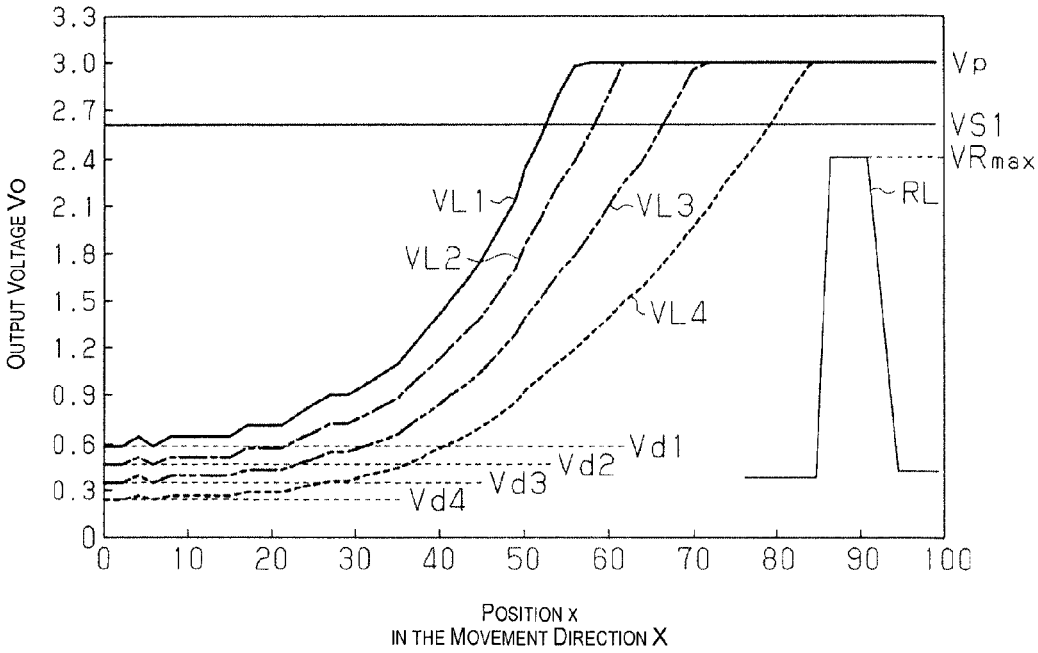
FIG. 9 is a schematic diagram illustrating correction data.
FIG. 10 is a graph illustrating the relationship between position and output voltage in a first detection processing.

The edge position correction unit 64 acquires the edge position Xe (edge position) by correcting the edge detection position Xd with the correction amount dx (Xe=Xd+dx). The non-volatile memory 54 stores correction data CD, illustrated in FIG. 9. As illustrated in FIG. 9, the correction data CD encompasses a correction amount dx1 that is used to correct the first edge side of the sheet of paper P, and a correction amount dx2 that is used to correct the second edge side of the sheet of paper P. In the present example, the positional coordinates of the position x of the sheet width sensor 48 in the movement direction X are set so that the direction from the home position toward the anti-home position becomes a positive direction. For this reason, the correction amount dx1, which is used in a case where the edge detection position Xd of the first edge side, which is the edge of the home position side, of the sheet of paper P is to be corrected, takes a negative value (in the example in FIG. 9, this is −2.6 mm), and the correction amount dx2, which is used in a case where the edge detection position Xd of the second edge side, which is the edge of the anti-home position side, is to be corrected, takes a positive value (in the example in FIG. 9, this is 2.5 mm).

The graph illustrated in FIG. 10 is meant to describe the first detection processing by the first detection unit 65, and illustrates the relationship between the output voltage Vo and the position x of the sheet width sensor 48 in the movement direction X. The position x is indicated by the count of the counter for counting the number of pulse edges of the pulse signal of the linear encoder 39, and the units thereof are 1/600 inch (where 1 inch=25.4 mm). In the graph in FIG. 10, the graph line VL1 illustrated with the solid line is of an initial state where there is no fouling of the sheet width sensor 48; with the graph line VL2 illustrated with a one-dot chain line, the graph line VL3 illustrated with a two-dot chain line, and the graph line VL4 illustrated with a dashed line, in the stated order, fouling has increasingly progressed. The graph line VL4 illustrates when fouling has reached an extent where the sensitivity of the sheet width sensor 48 arrives at the allowable limit.

As will be understood from the graph lines VL1 to VL4, when the sheet width sensor 48 is at the position x where the groove parts 71*a* are what is targeted for detection, the output voltage VO becomes the dark voltage Vd=Vd1, Vd2, Vd3, Vd4, respectively; increasing progression of fouling is accompanied by a corresponding decline in the dark voltage Vd (Vd1>Vd2>Vd3>Vd4). The edge of the sheet of paper P then becomes what is targeted for detection by the sheet width sensor 48, and the output voltage Vo is gradually elevated as the amount of the reflected light RL that is accounted for by the paper reflected light increases gradually together with changes in the position x. When the amount of light received by the light-receiving unit 59 reaches a certain constant value, the output voltage Vo reaches the paper voltage Vp (the saturation voltage), and thereafter is held at the paper voltage Vp.

The first threshold value VS1, which is used by the first detection unit 65 in the first detection processing, is set to a value that is higher than the maximum voltage VRmax of the rib waveform VR, illustrated in the graph in FIG. 10, for when the upstream ribs 73 are detected. The position at which the rib waveform VR appears, as is illustrated in FIGS. 8A and 8B, is closer to the home position side, which is the front side of the carriage in the direction of travel, than the position at which the output voltage Vo detects the edge of the sheet of paper P and begins to increase.

The first detection unit 65 compares the output voltage Vo of the sheet width sensor 48 and the first threshold value VS1 while the carriage 18 is in the process of moving from a position on one outside of the sheet of paper P in the width direction to a position on the other outside of the sheet of paper P, in a state where the sheet of paper P has been conveyed to the position where the upstream support surface 71 is covered in the conveyance direction Y; the first detection unit detects the edge of the sheet of paper P in response to when the output voltage Vo crosses over the first threshold value VS1. For any of the graph lines VL1 to V14, the edge of the sheet of paper P (the first edge) is detected in response to when the output voltage Vo, which was a value smaller than the first threshold value VS1, becomes greater than the first threshold value VS1. For this reason, the edge of the sheet of paper P is detected without any erroneous detection of the edge of the upstream ribs 73.

Figure 11:
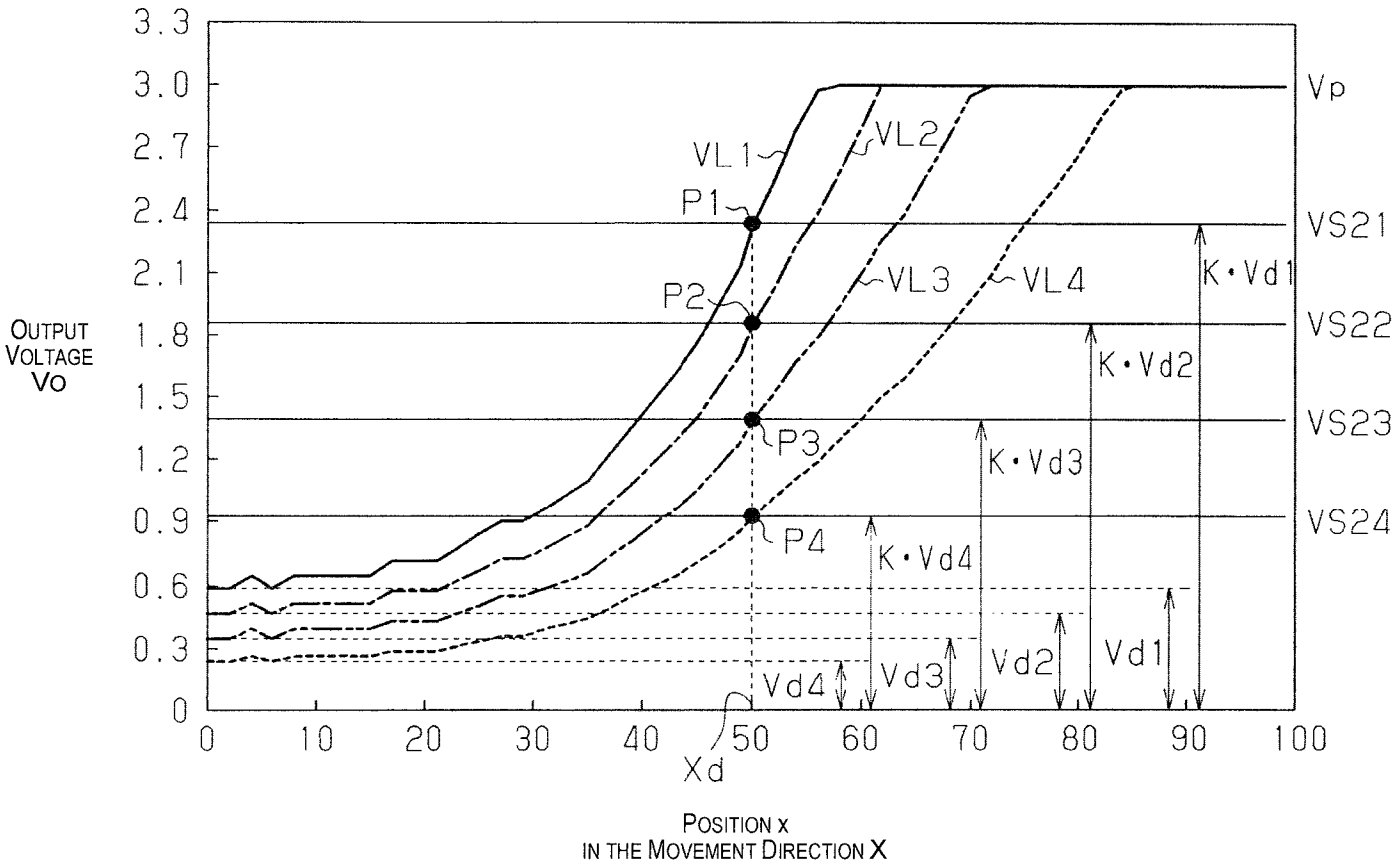
FIG. 11 is a graph illustrating the relationship between position and output voltage in a second detection processing.

The graph illustrated in FIG. 11 is for describing the second detection processing by the second detection unit 66, and illustrates the relationship between the output voltage Vo and the position x of the sheet width sensor 48 in the movement direction X. The position x is indicated in units of 1/600 inch (where 1 inch=25.4 mm), similarly with respect to the graph in FIG. 10. Each of the graph lines VL1 to VL4 illustrates the relationship between the position x and the output voltage Vo at the initial state and then respective stages of progression of fouling, as was described with the graph in FIG. 10.

As will be understood from the graph lines VL1 to VL4, the dark voltage Vd (Vd=Vd1, Vd2, Vd3, Vd4) for when the sheet width sensor 48 is at the position x where the groove parts 71*a* are what is targeted for detection declines increasingly with the progression of the fouling (Vd1>Vd2>Vd3>Vd4). The second threshold value VS2 is set by the threshold setting unit 62 to a value K-fold the dark voltage Vd detected by the dark voltage measurement unit 61. That is, in the initial state illustrated by the graph line VL1 of the solid line, a second threshold value VS21 is set to a value K-fold the dark voltage Vd1. Then, at each of the stages of progression of fouling (the graph lines VL2 to VL4), the second threshold value VS2 is set to a value K-fold the respective dark voltage Vd, i.e., VS22=K·Vd2, VS23=K·Vd3, VS24=K·Vd4.

Using a data group of the position x and the output voltage Vo acquired while the carriage 18 is in the process of moving and subsequently stored in the RAM 53 after the first detection unit 65 has detected the edge of the sheet of paper P, the second detection unit 66 compares the output voltage Vo of the sheet width sensor 48 and the second threshold value VS2, and detects the edge of the sheet of paper P in response to when the output voltage Vo crosses over the second threshold value VS2. The edge detection of the first detection unit 65 is intended to detect the sheet of paper by distinguishing same from the upstream ribs 73, and in order to find the position of the edge detected by the first detection unit 65, the second detection unit 66 detects the edge corresponding to that position. For any of the graph lines VL1 to V14, the edge of the sheet of paper P (the first edge) is detected when the output voltage Vo, which was a value smaller than the second threshold value VS2, becomes greater than the second threshold value VS2. The position x for when the edge of the sheet of paper P is detected, then, is acquired as the edge detection position Xd. In the example in FIG. 11, in both the initial state and the plurality of states of stages of fouling, the output voltage Vo at each of the graph lines VL1 to VL4 crosses over the second threshold values VS21, VS22, VS23, VS24 at points P1 to P4, respectively, and the same edge detection position Xd (x=50) is acquired.

When, for example, the sheet width sensor 48 is fouled or the like, the amount of light received is reduced, and there is a decline in the sensitivity thereof, then the amount of light received by the light-receiving unit 59 when at the position for detecting the edge position of the sheet of paper P declines at the same ratio as the amount of light received by the light-receiving unit 59 when at the position for detecting the groove parts 71*a* (the dark region). For example, in FIG. 8B, the paper reflected light accounts for 0 of the reflected light RL for when the groove parts 71*a* are detected accounts (the dark grey region), and the paper reflected light accounts for 0.5 of the reflected light RL for when the sheet width sensor 48 detects the edge position of the sheet of paper P (50% dark grey region and 50% white region). In a case where the sensitivity of the sheet width sensor 48 has declined due to fouling, the amount of light received by the light-receiving unit 59 receiving the respective reflected lights RL is reduced in accordance with the decline in the sensitivity, but the ratio between the amounts of light received by the light-receiving unit 59 receiving the reflected lights RL where the paper reflected light accounts for 0 and 0.5, respectively, is substantially constant.

For this reason, when the second threshold value VS2 is set to the value found by multiplying the constant K by the dark voltage Vd (measurement value) corresponding to the amount of light received when the sheet width sensor 48 detects the groove parts 71*a*, then the position of the sheet width sensor 48 when the output voltage Vo crosses over the second threshold value VS2 (the edge detection position Xd) will be the same irrespective of differences in the sensitivity arising because of fouling of the sheet width sensor 48. Herein, in order for it to be possible to detect the edge of the sheet of paper P, it is necessary for the second threshold value VS2 to be set to a range between the minimum value (dark voltage. Vd) and maximum value (paper voltage Vp) that can be taken by the output voltage Vo of the sheet width sensor 48 (Vd<VS2<Vp). Because of this, in the present embodiment, the constant K is set to a range 1<K<Vp/Vd. In the example in FIG. 11, in the initial state, Vd=0.6 (V) and Vp=3.0 (V), and therefore 1<K<5; as one example, K is set to K=4, because it is desirable to avoid the vicinity of the lower limit and the vicinity of the upper limit within this range.

Figure 12:
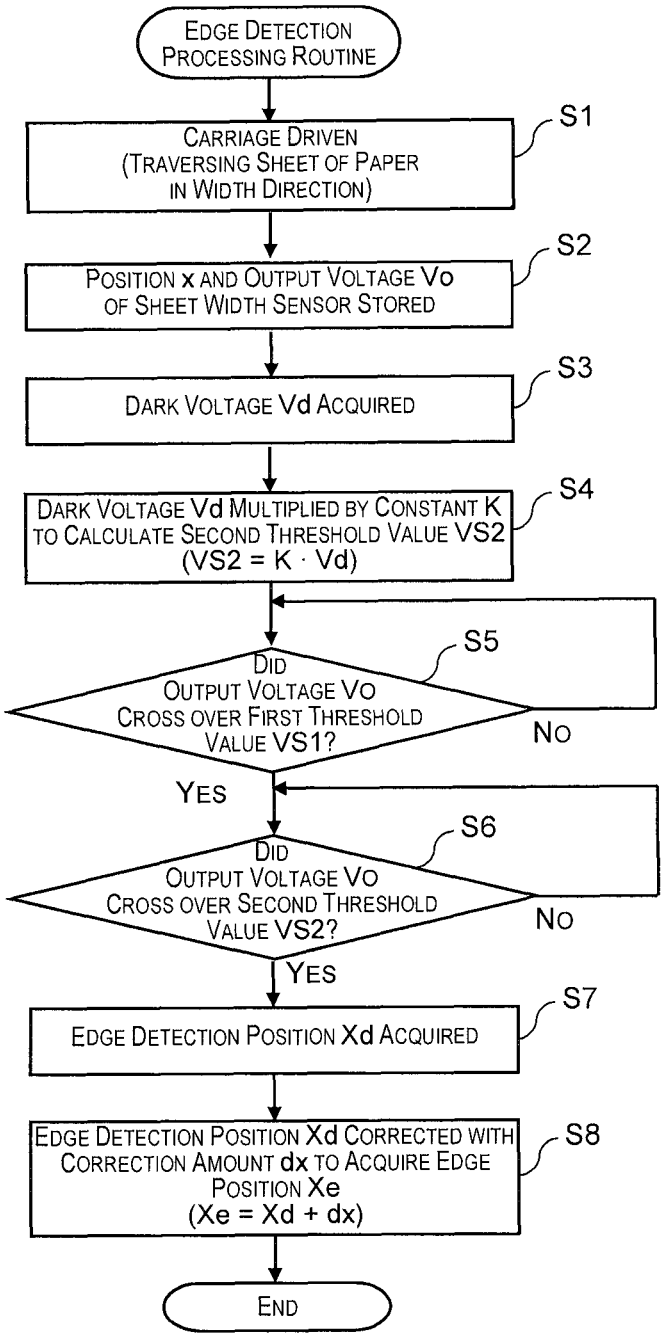
FIG. 12 is a flow chart illustrating an edge detection processing routine.

The operation of the printer 11 of the present embodiment shall now be described with reference to the flow chart illustrated in FIG. 12. The control unit 50 executes a program for the edge detection processing routine illustrated with the flow chart in FIG. 12. When the edge detection processing is carried out, the control unit 50 drives the conveyance motor 41 and causes the sheet of paper P to be conveyed to the position where the upstream support surface 71 is covered. The control unit 50 initiates the edge detection processing when the sheet of paper P is conveyed to the position where the upstream support surface 71 is covered, or when the sheet of paper has passed through a predetermined position midway during the conveyance thereof and a predetermined timing is reached permitting detection of the first edge of the sheet of paper P by the sheet width sensor 48.

First, in step S1, the carriage 18 is driven and the sheet of paper P is moved so as to traverse the width direction. The control unit 50 drives the carriage motor 35 and moves the carriage 18, which is located at, for example, the home position side, toward the anti-home position side at a constant speed. At this time, the sheet width sensor 48 receives with the light-receiving unit 59 the reflected light of the light irradiated toward the support base 38 side from the light-emitting unit 58, and outputs to the control unit 50 the output voltage Vo corresponding to the amount of light received thereby.

In the next step S2, the position x and the output voltage Vo of the sheet width sensor 48 are stored. That is, the second detection unit 66 inside the control unit 50 sequentially acquires the position x and the output voltage Vo of the sheet width sensor 48 during movement in the movement direction X together with the carriage 18 and stores same in a predetermined storage region of the RAM 53, in order to ensure the data that is used in the second detection processing. The processing in steps S1 and S2 is executed continuously until the later processing is ended.

In step S3, the dark voltage Vd is acquired. That is, the dark voltage measurement unit 61 reads the output voltage Vo corresponding to the position x of the groove parts 71*a* from the RAM 53, and acquires same as the dark voltage Vd.

In step S4, the second threshold value VS2 is calculated by multiplying the dark voltage Vd by the constant K. That is, the threshold setting unit 62 sets the second threshold value VS2 to the value found by multiplying the dark voltage Vd by the constant K. In step S5, a determination is made as to whether or not the output voltage Vo has crossed over the first threshold value VS1. That is, the first detection unit 65 compares the output voltage Vo and the first threshold value VS1, and determines whether or not the output voltage Vo has changed from a value smaller than the first threshold value VS1 to a value greater than same, or whether or not the output voltage Vo has changed from a value greater than the first threshold value VS1 to a value smaller than same. In a case where the output voltage Vo has not crossed over the first threshold value VS1, this processing is repeated until the output voltage Vo is determined to have crossed over the first threshold value VS1. In the present example, because the first edge is detected first, the first edge is detected in response to when the output voltage Vo passes from a value below the output voltage Vo to a value above. The flow proceeds to step S6 when the output voltage Vo is determined to have crossed over the first threshold value VS1. The processing in step S5 is equivalent to one example of a first detection step.

In step S6, a determination is made as to whether or not the output voltage Vo has crossed over the second threshold value VS2. That is, the second detection unit 66 compares the output voltage Vo and the second threshold value VS2, and determines whether or not the output voltage Vo has changed from a value smaller than the second threshold value VS2 to a value greater than same, or whether or not the output voltage Vo has changed from a value greater than the second threshold value VS2 to a value smaller than same. In a case where the output voltage Vo has not crossed over the second threshold value VS2, this processing is repeated until the output voltage Vo is determined to have crossed over the second threshold value VS2. When, for example, the position of the first edge of the sheet of paper P is being detected, then the first edge is detected in response to when the output voltage Vo crosses the second threshold value VS2 from a value lower than the second threshold value. The flow proceeds to step S7 when the output voltage Vo is determined to have crossed over the second threshold value VS2.

In step S7, the edge detection position Xd is acquired. That is, the second detection unit 66 reads the position x corresponding to the output voltage Vo of when the second threshold value VS2 was crossed over, from the RAM 53, and acquires the position x thus read as the edge detection position Xd. The processing in steps S6 and S7 is equivalent to one example of a second detection step.

In step S8, the edge position Xe is acquired by correcting the edge detection position Xd with the correction amount dx. That is, the edge position correction unit 64 determines whether the edge intended for positional detection is the first edge or the second edge, from the value of the edge detection position Xd, and consult the correction data CD (FIG. 9) to acquire the correction amount dx corresponding to the edge of the side thus determined. In this example, because the first edge is detected first, the correction data CD is consulted to acquire the correction amount dx1 corresponding to the first edge. The edge position correction unit 64 then calculates the edge position Xe1 of the first edge by adding the correction amount dx1 to the edge detection position Xd1 (Xe1=Xd1+dx1).

When the detection of the edge position Xe1 of the first edge is ended in this manner, the control unit 50 subsequently carries out the processing of steps S5 to S8 to carry out the edge detection processing for the second edge. That is, the second edge is detected in response to when the output voltage Vo changes from a value above the first threshold value VS1 to a value below (S5). Then, when a determination is made as to whether or not the output voltage Vo changed from a value above the second threshold value VS2 to a value below (an affirmative determination in S6), the position x of when the output voltage Vo crossed the second threshold value VS2 downward is acquired as the edge detection position Xd2 of the second edge (S7). The edge detection position Xd2 is corrected with the correction amount dx2 corresponding to the second edge to acquire the edge position Xe2 (=Xd2+dx2).

As has been described above, according to the first embodiment, the effects presented below can be obtained.

(1) The first detection unit 65 detects the edge of the sheet of paper P by comparing the output voltage Vo and the first threshold value VS1 and, when the edge of the sheet of paper is detected by the first detection unit 65, then the second detection unit 66 next compares the output voltage Vo and the second threshold value VS2 and detects the edge position of that edge. For this reason, the edge position of the sheet of paper P can be detected without erroneously detecting the edge of the upstream ribs 73 as being the edge of the sheet of paper P, even though the region targeted for detection when the sheet width sensor 48 moves in the movement direction X includes the upstream ribs 73 (protrusions) of high reflectivity for causing the light-receiving unit 59 to output the output voltage Vo of such a voltage waveform that the second threshold value VS2 is crossed.

(2) Erroneous detection of the upstream ribs 73 can be avoided because the first threshold value VS1 is set to a value that is greater than the maximum voltage VRmax of the rib waveform VR outputted when the sheet width sensor 48 detects the upstream ribs 73, and to a value smaller than the paper voltage Vp.

(3) The amount of positional deviation between the edge detection position Xd and the actual edge position of the sheet of paper can be rendered constant at all times, regardless of the sensitivity (fouling) of the sheet width sensor 48, because the second threshold value VS2 is a value found by multiplying the dark voltage Vd by the constant K. Accordingly, the processing for calculating the edge position Xe can be a relatively simple process, because the correction amount dx that is used in calculating the edge position Xe from the edge detection position Xd can be a constant value. For example, a case adopting a configuration where the correction amount dx is altered in accordance with the sensitivity, which varies depending on the extent of fouling of the sheet width sensor 48 would necessitate configurations for a sensitivity measurement unit that would measure the sensitivity of the sheet width sensor, a correction amount acquisition unit that would find a correction amount corresponding to the sensitivity, and the like. However, in the present embodiment, because the correction amount dx is a constant value, it is relatively easy to calculate the edge position Xe from the edge detection position Xd.

(4) Because of the setting to a constant K that allows for the second threshold value VS2 to be set between the dark voltage Vd and the paper voltage Vp ($1<K<Vp/Vd$), a proper second threshold value VS2 can be set, and the edge detection position Xd from the second detection unit 66 can be reliably detected. Even though the sensitivity varies depending on the fouling of the sheet width sensor 48, an edge detection position Xd for which the amount of positional deviation from the actual edge position of the sheet of paper P is substantially constant, regardless of differences in the sensitivity of the sheet width sensor 48, can be acquired, because the second threshold value VS2 is set to a value found by multiplying the dark voltage Vd corresponding to the sensitivity at the time by the constant K.

(5) After the position x and the output voltage Vo of the sheet width sensor 48 have been sequentially stored in the RAM 53 during the movement of the carriage 18 and after edge detection by the first detection unit 65, the second detection unit 66 acquires the edge detection position Xd by comparing the output voltage Vo and the second threshold value VS2 by using the data group of the positions x and output voltages Vo stored in the RAM 53. Accordingly, the second detection unit 66 is able to detect the edge position even though the sheet width sensor 48 has already passed the position where the output voltage Vo crosses over the second threshold value VS2 (the edge position) at the point in time where the first detection unit 65 detects the edge of the sheet of paper P.

(6) Because the measurement of the dark voltage Vd and the processing for setting the second threshold value VS2 are carried out during the process of moving the carriage 18 at the time of the edge detection processing, the number of times the carriage 18 must be moved can be reduced in comparison to a configuration where the measurement of the dark voltage Vd and the processing for setting the second threshold value VS2 are carried out during separate processes for moving the carriage 18. This leads, for example, to an improvement in the throughput of the printer 11.

Second Embodiment

The second embodiment shall now be described on the basis of FIG. 13. In the first embodiment, the second threshold value VS2 found by multiplying the dark voltage Vd by a constant was set, but the present embodiment is an example where the second threshold value VS2 is given a constant value by multiplying the output voltage Vo by a constant. The electrical configuration of the printer 11 is similar to that of the first embodiment, and the functional configuration of the control unit 50 is also similar except in that there is no threshold setting unit 62. Instead of the edge detection processing program illustrated by the flow chart in FIG. 12, the non-volatile memory 54 stores an edge detection processing program illustrated by the flow chart in FIG. 13.

Figure 13:
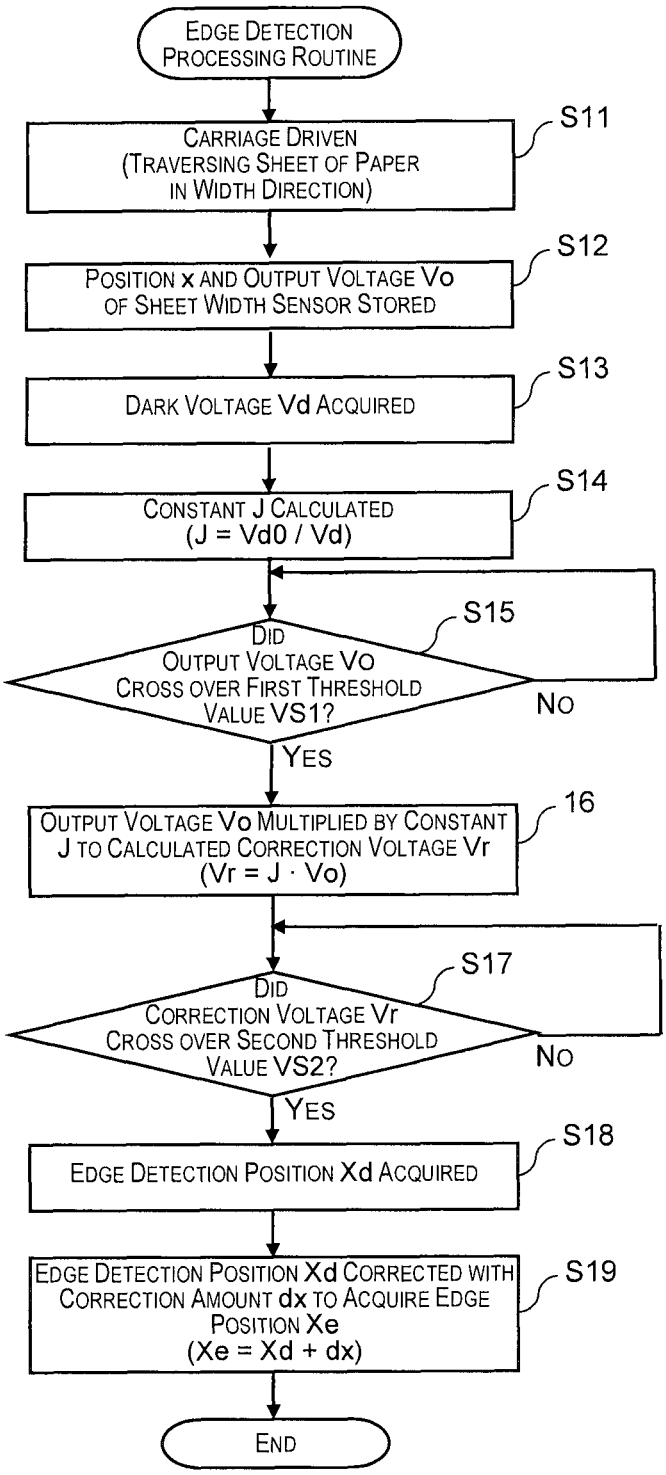
FIG. 13 is a flow chart illustrating an edge detection processing routine in a second embodiment.

The edge detection processing in the present embodiment shall be described on the basis of FIG. 13. When the edge detection processing is being carried out, the control unit 50 drives the conveyance motor 41 and causes the sheet of paper P to be conveyed to the position where the upstream support surface 71 is covered. The control unit 50 initiates the edge detection processing when the sheet of paper P is conveyed to the position where the upstream support surface 71 is covered, or when a predetermined timing is reached at which the sheet of paper P has passed through a predetermined position midway in the conveyance thereof.

Firstly, the processing for steps S11 to S13 is similar processing to that of steps S1 to S3 in the first embodiment. That is, the control unit 50 drives the carriage motor 35 and moves the carriage 18, located for, for example, the home position side, at a constant speed toward the anti-home position side (S11). The control unit 50 then sequentially acquires the position x and the output voltage Vo of the sheet width sensor 48 while the carriage 18 is in the process of moving, and stores same in the RAM 53 (S12). The dark voltage measurement unit 61 acquires as the dark voltage Vd the output voltage Vo acquired at the position where the groove parts 71*a* are what the sheet width sensor 48 targets for detection while the carriage 18 is in the process of moving (S13).

In step S14, a constant J (=Vd0/Vd) is calculated. Herein, Vd0 is an initial value of the dark voltage Vd. The constant J is meant to be used during the second detection processing by the second detection unit 66, and the calculation of the constant J is carried out by the second detection unit 66. The initial value Vd0 of the dark voltage either is set, for example, by being measured when the printer is delivered, or is set by being measured in an initial operation during the very first usage after purchase of the printer.

The next step S15 is similar processing to that of step S5 in the first embodiment; in this processing, the first detection unit 65 determines whether or not the output voltage Vo has crossed over the first threshold value VS1. In a case where the output voltage Vo has not crossed over the first threshold value VS1, the processing is repeated until the output voltage Vo is determined to have crossed over the first threshold value VS1; the flow proceeds to step S16 when the output voltage Vo is determined to have crossed over the first threshold value VS1.

In step S16, the output voltage Vo is multiplied by the constant J to calculate a correction voltage Vr (Vr=J·Vo). This processing is carried out by the second detection unit 66. In the next step S17, a determination is made as to whether or not the correction voltage Vr has crossed over the second threshold value VS2. That is, the second detection unit 66 compares the correction voltage Vr and the second threshold value VS2 and determines whether or not the correction voltage Vr has changed from a value smaller than the second threshold value VS2 to a value greater than same, or whether or not the correction voltage has changed from a value greater than the second threshold value VS2 to a value smaller than same. In a case where the correction voltage Vr has not crossed over the second threshold value VS2, the processing is repeated until the correction voltage Vr is determined to have crossed over the second threshold value VS2. During, for example, positional detection of the first edge of the sheet of paper P, the first edge is detected in response to when the correction voltage Vr passes from a value below the second threshold value VS2 to a value above. Thus, when the correction voltage Vr is determined to have crossed over the second threshold value VS2, the flow proceeds to step S18.

In step S18, the edge detection position Xd is acquired. That is, the second detection unit 66 reads out from the RAM 53 the position x corresponding to the output voltage Vo used in the calculation of the correction voltage Vr of when the second threshold value VS2 was crossed over, and acquires the position x thus read as the edge detection position Xd.

In the next step S19, the edge position Xe is acquired by correcting the edge detection position Xd with the correction amount dx. That is, the edge position correction unit 64 determines whether the edge intended for positional detection is the first edge or the second edge, from the value of the edge detection position Xd, and consult the correction data CD (FIG. 9) to acquire the correction amount dx corresponding to the edge of the side thus determined. In this example, because the first edge is detected first, the correction data CD is consulted to acquire the correction amount dx1 corresponding to the first edge. The edge position correction unit 64 then calculates the edge position Xe1 of the first edge by adding the correction amount dx1 to the edge detection position Xd1 (Xe1=Xd1+dx1).

When the detection of the edge position Xe1 of the first edge is ended in this manner, the control unit 50 subsequently carries out the processing of steps S15 to S19 and carries out the position detection processing for the second edge. That is, the second edge is detected in response to when the output voltage Vo changes from a value above the first threshold value VS1 to a value below (S15). The output voltage Vo is multiplied by the constant J to calculate the correction voltage Vr (Vr=J·Vo) (S16). Next, a determination is made as to whether or not the correction voltage Vr has crossed over the second threshold value VS2 (S17). During the second edge detection, when the correction voltage Vr is determined to have changed from a value above the second threshold value VS2 to a value below (an affirmative determination in S17), the position x of when the correction voltage Vr crossed over the second threshold value VS2 from below is acquired as the edge detection position Xd2 of the second edge (S18). The edge detection position Xd2 is corrected with the correction amount dx2 corresponding to the second edge to acquire the edge position Xe2 (=Xd2+dx2).

As has been described above, according to the second embodiment, the effects presented below can be obtained.

(7) The constant J (=Vd0/Vd) is calculated, the correction voltage Vr is found by multiplying the output voltage Vo by the constant J, the edge of the sheet of paper P is detected in response to when the correction voltage Vr crosses over the second threshold value VS2, and the position x corresponding to the output voltage Vo used in calculating the correction voltage Vr at that time is acquired as the edge detection position Xd. Accordingly, because the second threshold value VS2 can be given a constant value, there is no need for processing for calculating or setting the second threshold value VS2 used by the second detection unit 66.

The embodiments described above can also be altered to the following modes. The processing (second threshold value setting processing) for acquiring the dark voltage Vd (S3) and setting the second threshold value VS2 (S4) in the first embodiment, rather than being carried out in the edge detection processing routine, can instead be carried out in advance as processing that is separate from the edge detection processing routine. Similarly, the processing (constant setting processing) in which the dark voltage Vd is acquired (S13) and the constant J is calculated (S14) in the second embodiment, rather than being carried out in the edge detection processing routine, can instead be carried out in advance as processing that is separate from the edge detection processing routine. For example, it would be possible to adopt a configuration in which the second threshold value setting processing or the constant setting processing is executed as a part of the initial processing that is implemented when the printer 11 is powered on (when the printer is started up). It would also be possible to adopt a configuration in which the second threshold value setting processing or constant setting processing is executed every time the cumulative number of sheets printed counted by the control unit 50 reaches a setting number of sheets. Each processing can also be executed at execution timings for both.

The comparison value used by the second detection unit 66 together with the output voltage Vo (output value) in order to detect the edge position is not limited to being a threshold value. For example, with the dark voltage Vd serving as the comparison value, a linear approximation formula Vo=Ax+B (where A and B are constants) is found by using, for example, the least-square method to linearly approximate a point group of a portion where the output voltage Vo is sloped (i.e., a portion where the amount of reflected light RL in FIG. 8B occupied by the paper reflected light changes). Then, by using the linear approximation formula Vo=Ax+B, the position x of when the output voltage Vo takes the value of the dark voltage Vd (when Vo=Vd) is calculated and this position x serves as the edge detection position Xd. The point group of the dark voltage Vd is also linearly approximated with, for example, the least-square method, to find a linear approximation formula Vo=Cx+D (where C and D are constants). It would further be possible to adopt a configuration in which the point of intersection between the linear approximation formula Vo=Cx+D and the linear approximation formula Vo=Ax+B is calculated as the edge detection position Xd. These manners of detecting the position of the edge of the medium by using the output value and the comparison value also encompass a configuration in which the edge detection position Xd is found by a calculation that uses a comparison value and a linear approximation value prescribed by a point group of the output voltage Vo (output value). The approximation formula prescribed from the point group of the output value is not limited to being a linear approximation formula (a first-order approximation formula), but rather can also be a curve approximation formula such as a second-order approximation formula or a third-order approximation formula.

It would additionally be possible to adopt a configuration in which the maximum voltage VRmax of the rib waveform Vr is found on the basis of the output voltage Vo of the sheet width sensor 48 at the position x where the upstream ribs 73 are what is targeted for detection, the maximum voltage VRmax and the second threshold value VS2 are compared, and, when VRmax+$\alpha \geq$VS2 (where a is a margin), processing by the first detection unit 65 and the second detection unit 66 is carried out, but when VRmax+$\alpha$<VS2, then the processing of the first detection unit 65 is not carried out whereas the processing of the second detection unit 66 is carried out. According to this configuration, it is possible to forgo the processing by the first detection unit 65 until the upstream ribs 73 have been abraded by the sliding of the sheet of paper P and VRmax+a≥VS2 holds true.

The constant K can be altered as appropriate. In brief, the second threshold value should be set so as to be less than the value when the voltage is saturated (the paper voltage Vp) when the dark voltage Vd is multiplied by a constant. In other words, it should be possible to set the second threshold value to be a voltage value within the range where the edge of the sheet of paper can be detected, when multiplied by a constant. The constant K can be, for example, K=2 or K=3.

The configuration can be one where the edge detection processing is executed only when the edge on the side where the ribs are located just before the edge of the sheet of paper in the carriage movement direction during the edge detection processing (this is the first edge in each of the embodiments above) is detected; when the edge on the side where the edge of the sheet of paper is located just before the ribs (protrusions) in the carriage movement direction, the detection processing with the first threshold value is not carried out, whereas the detection of the edge position of the sheet of paper using the second threshold value is carried out.

The reflecting surface for acquiring the dark voltage is not limited to being the groove parts 71*a*, and can be altered as appropriate. For example, the reflecting surface can be the bottom of a recess that is deeper than the groove parts. The reflecting surface can also be a light-absorbing surface obtained when a light-absorbing layer provided to a predetermined position in the upstream support surface 71 of the support base is formed on the surface. Also, rather than being below the position where the carriage 18 passes during printing, the reflecting surface serving as the dark region can instead be arranged at a position that is outside of the liquid ejecting region PA in the movement direction X.

Although the second threshold value VS2 changes depending on the fouling of the sheet width sensor 48, there can also exist some cases where the second threshold value VS2 takes a value that is greater than the first threshold value VS1. For example, there can be a case where the second threshold value takes a value equal to or greater than the first threshold value, such as the first time the printer is used immediately following purchase.

The second threshold value VS2 is not limited to being a constant factor of the dark voltage Vd, but rather can also be a constant value that is not proportional to the dark voltage. Further, as is described in Patent Documents 2 and 3, a threshold value corresponding to the ratio of the respective output voltages where the ribs and groove parts of the support base are detected by the optical sensor can be set.

The carriage movement direction during the edge detection processing can be a direction going from the anti-home position side to the home position side. The optical sensor for detecting the widthwise edge position of the medium is not limited to being a sheet width sensor the purpose of which is to acquire the sheet width or is to determine an ejection start position (print start position) in the movement direction X (main scanning direction) of the liquid ejecting head 19. For example, the purpose can be merely to acquire the edge position of the medium in the width direction. The purpose can also be to detect the skew (slant) of the medium.

The detection circuit of the sheet width sensor 48 is a circuitry configuration where the output voltage Vo is higher when the light-receiving unit 59 receives a greater amount of light and where the output voltage Vo is lower when a lesser amount of light is received, but inversely thereto, it would also be possible to adopt a circuitry configuration in which the output voltage Vo is lower when a greater amount of light is received by the light-receiving unit 59 and where the output voltage Vo is higher when a lesser amount of light is received. In such a case, when a calculation is carried out in which the output voltage Vo of when the groove parts 71*a* were detected is subtracted from the power source voltage Vcc, then it would be possible to acquire the dark voltage Vd (=Vcc−Vo) found by measuring the amount of light received by the light-receiving unit 59 at the sensor position for when the dark region (the groove parts 71*a*) is targeted for detection. The dark voltage should be measured as being a value such that when the amount of light received by the light-receiving unit 59 is reduced, the value thereof is correspondingly lower, regardless of the configuration of the detection circuit of the optical sensor.

Each of the functional units inside the control unit 50 (computer) in FIGS. 3A and 3B is achieved primarily with software by a CPU that executes programs, but, for example, each of the functional units can also be achieved with hardware by an integrated circuit, or can be achieved by cooperation between software and hardware.

The liquid ejecting apparatus is not limited to being a printer, but rather can also be a multifunction peripheral provided with a plurality of functions in addition to a printer function, such as a scanner function and a copy function. The printer (print device) is not limited to being a serial printer, but rather can also be a lateral printer, a line printer, or a page printer. In the case of, for example, a fixed configuration where the liquid ejecting head 19 fundamentally does not move, such as a line printer or a page printer, then there will be a small-sized carriage for moving the optical sensor, the configuration being one where the optical sensor is provided to this small-sized carriage. In the case of such line printers and page printers, too, the edge detection position of the medium can be properly detected without erroneous detection as being the edge of protrusions such as ribs.

The medium is not limited to being a sheet of paper, but rather can also be a resin film, a metal foil, a metal film, a composite film of resin and metal (a laminate film), a textile, a non-woven fabric, a ceramic sheet, or the like. Further, the shape of the medium is not limited to being a sheet, but can rather be a three-dimensional shape.

In the embodiments described above, the invention was embodied in an inkjet printer, which is one type of liquid ejecting apparatus, but there is no limitation to printers in cases where the invention is applied to a liquid ejecting apparatus. For example, the invention can also be embodied in a liquid ejecting apparatus for ejecting or discharging a different liquid other than ink (including a fluid body such as a liquid body or gel that is formed by dispersing or mixing particles of a functional material into a liquid). For example, the invention can be a liquid ejecting apparatus for ejecting a liquid body that includes, in a dispersed or dissolved form, a material such as a colorant (a pixel material) or an electrode material used, inter alia, to produce liquid crystal displays, electroluminescence (EL) displays, or surface emitting displays. The invention can further be a liquid ejecting apparatus for ejecting bio-organic matter used in the production of biochips, or a liquid ejecting apparatus for ejecting a liquid serving as a test sample, used as a precision pipette. Furthermore, the invention can be: a liquid ejecting apparatus for ejecting onto a substrate a translucent resin solution, such as a thermosetting resin, for forming, inter alia, a hemispherical micro lens (optical lens) used in an optical communication element or the like; a liquid ejecting apparatus for ejecting an etching solution, such as an acid or an alkali, to etch a substrate or the like; or a fluid ejecting apparatus for ejecting a fluid such as a gel (for example, a physical gel) or the like. The invention can be applied to any of these types of fluid ejecting apparatuses. In this manner, the medium (recording medium) can also be a substrate on which an element, wiring, or the like is to be formed by etching. The "liquid" ejected by the liquid ejecting apparatus encompasses liquids (including inorganic solvents, organic solvents, solutions, liquid resins, liquid metals (metal melts), and the like), liquid bodies, fluid bodies, and so forth.

What is claimed is:

1. A liquid ejecting apparatus, comprising:

a liquid ejecting head for ejecting a liquid toward a medium;

a light reflection optical sensor which is provided to a carriage able to move in a movement direction that intersects with a conveyance direction for the medium, which has a light-emitting unit and a light-receiving unit, and which outputs an output value corresponding to an amount of light received by the light-receiving unit;

a support unit having a plurality of protrusions for supporting the medium;

a first detection unit for detecting an edge of the medium by comparing a threshold value at which the medium can be detected and the protrusions cannot be detected and an output value of the optical sensor moving the movement direction in a state where the medium has been conveyed to a position at which detection by the optical sensor is possible; and a second detection unit for detecting a position of the edge by using the output value of the optical sensor and a comparison value when the edge of the medium is detected by the first detection unit.

2. The liquid ejecting apparatus as set forth in claim 1, wherein in a case where the threshold value is a first threshold value, the comparison value is a second threshold value, and the second detection unit detects a position of when the output value of the optical sensor crosses over the second threshold value as being the position of the edge of the medium.

3. The liquid ejecting apparatus as set forth in claim 2, wherein a dark region where an amount of light received by the light-receiving unit receiving the reflected light formed when the light from the light-emitting unit is reflected becomes less than that of the protrusions is provided to a region targeted for detection by the optical sensor, the liquid ejecting apparatus being further provided with:

a measurement unit for measuring the amount of light received by the light-receiving unit receiving the reflected light of the light with which the dark region is irradiated by the light-emitting unit; and a threshold value setting unit for setting the second threshold value to a value found by multiplying a measurement value of the amount of received light by a constant.

4. The liquid ejecting apparatus as set forth in claim 3, wherein the constant is set to a value allowing for the second threshold value to be set to a range between the output value of the optical sensor for when the dark region is what is targeted for detection and the output value of the optical sensor for when the medium is what is targeted for detection.

5. The liquid ejecting apparatus as set forth in claim 2, wherein a dark region where an amount of light received by the light-receiving unit receiving the reflected light formed when the light from the light-emitting unit is reflected becomes less than that of the protrusions is provided to a region targeted for detection by the optical sensor, the liquid ejecting apparatus being further provided with:

a measurement unit for measuring the amount of light received by the light-receiving unit receiving the reflected light of the light with which the dark region is irradiated by the light-emitting unit, and the second detection unit multiplies the output value of the optical sensor by a constant prescribed on the basis of a ratio between a measurement value of the amount of received light and an initial value of the measurement value, and detects as the position of the edge of the medium a position of when the output value multiplied by the constant crosses over the second threshold value.

6. The liquid ejecting apparatus as set forth in claim 1, wherein after the output value and the position of the optical sensor have been sequentially stored in a storage unit during the movement of the carriage and the edge of the medium has been detected by the first detection unit, the second detection unit detects the position of the edge by using a data group of the positions and the output values stored in the storage unit.

7. The liquid ejecting apparatus as set forth claim 1, wherein the liquid ejecting apparatus is further provided with a correction unit for acquiring the position of the edge of the medium by correcting with a constant correction amount the edge detection position detected by the second detection unit.

8. A method for detecting a medium edge position in a liquid ejecting apparatus, the method comprising:

detecting an edge of a medium by comparing an output value of an optical sensor moving in a movement direction that intersects with a conveyance direction of the medium, in a state where the medium has been conveyed to a position where detection by the optical sensor is possible, and a threshold value at which the medium can be detected and a plurality of protrusions for supporting the medium cannot be detected; and detecting the position of the edge by using a comparison value and the output value of the optical sensor, when the edge of the medium is detected in the first detection step.

* * * * *